US009179807B2

(12) United States Patent
Campbell et al.

(10) Patent No.: US 9,179,807 B2
(45) Date of Patent: Nov. 10, 2015

(54) SUPPORT FOR SHOWER PAN OR TUB

(75) Inventors: Eric Campbell, Chicago, IL (US); Ajit Ranade, Naperville, IL (US)

(73) Assignee: Sonoco Development, Inc., Hartsville, SC (US)

( * ) Notice: Subject to any disclaimer, the term of this patent is extended or adjusted under 35 U.S.C. 154(b) by 555 days.

(21) Appl. No.: 13/616,192

(22) Filed: Sep. 14, 2012

(65) Prior Publication Data

US 2014/0075666 A1 Mar. 20, 2014

(51) Int. Cl.
*A47K 3/34* (2006.01)
*A47K 3/40* (2006.01)

(52) U.S. Cl.
CPC ..... *A47K 3/40* (2013.01); *Y10T 29/4998* (2015.01)

(58) Field of Classification Search
CPC ..... A47K 3/40
USPC ..... 4/612, 613
See application file for complete search history.

(56) References Cited

U.S. PATENT DOCUMENTS

| | | | | |
|---|---|---|---|---|
| 2,836,830 | A | 6/1958 | Norman | |
| 3,149,347 | A | 9/1964 | Embroden | |
| 4,541,132 | A | 9/1985 | Long | |
| 5,140,789 | A * | 8/1992 | De Gooyer | 4/613 |
| 6,003,169 | A | 12/1999 | Davis, Jr. | |
| 8,230,535 | B2 | 7/2012 | Kik, Sr. et al. | |
| 2007/0067903 | A1 | 3/2007 | Hatrick-Smith | |
| 2008/0222795 | A1 | 9/2008 | Cook | |
| 2008/0276364 | A1 | 11/2008 | Barro et al. | |
| 2011/0197354 | A1 * | 8/2011 | Wedi | 4/613 |

* cited by examiner

*Primary Examiner* — Tuan N Nguyen
(74) *Attorney, Agent, or Firm* — Miller, Matthias & Hull LLP

(57) ABSTRACT

A support for supporting a shower pan is provided. The support comprises an expanded polypropylene tray defining a cavity, an intermediate layer made of oriented strand board and disposed with the cavity, and a top layer made of expanded polystyrene foam disposed with the cavity and having a contoured top surface substantially matching the contoured underside of the shower pan.

13 Claims, 2 Drawing Sheets

58
60
16
52
54
56
10
46
48
14
40
42
44
44
24
20
34
34
32
22
36
20
38
20
28
34
12
30
18
34
20

SUPPORT FOR SHOWER PAN OR TUB

BACKGROUND OF THE INVENTION

1. Field of the Invention

This invention patent relates to a support for a shower pan or tub. More particularly, this invention relates to a multi-layer, multi material support for a replacement shower pan or tub.

2. Background

Shower enclosures may be custom made to a specific location or prefabricated at a factory. Prefabricated shower enclosures typically include a door and shower walls that fit within a shower pan. The shower pan serves as the floor of the shower on which the user stands. The shower pan includes a drain opening and may be installed over an existing shower floor. During installation of a prefabricated shower enclosure, a support may be installed between the shower pan and the floor to support the shower pan.

Some supports are sold along with the replacement shower enclosure and others are sold separately. Different types of supports are known. For example, U.S. Pat. No. 4,541,132 discloses a shower pan supported by graduated shims and perimeter strips which are in turn mounted on a planar foundation. U.S. Pat. No. 6,003,169 discloses a shower pan supported by an expanded polystyrene foam (EPF) layer located between the shower pan and a wood base. U.S. Pat. No. 6,003,169 also discloses a shower pan supported by a system of stringers. U.S. Patent Publication No. 2008/0276364 discloses a shower pan supported by a honeycomb lattice structure.

Replacement shower manufacturers sometimes provide a molded foam support made of expanded polystyrene to support the shower pan. The foam support may be placed under the shower pan on top of the floor during installation. Sometimes the foam support will be pre-glued to the underside of the shower pan at the factory. Either way, installed on site or pre-glued at the factory, shower pan failures can be caused by poor installation of the support or poor support design. For example, if the support has been installed crooked and/or not flush to the floor and/or not placed on a flat surface, the shower or tub pans can crack under pressure from the user's weight. Cracked shower pans can lead to water leaks that can cause significant water damage.

In some cases the foam support that is packaged with the prefabricated shower stalls has been discarded because the installers thought the support was part of the packaging material. In other cases, the foam support is installed correctly, but over time the shower or tub pan still cracks or otherwise fails before the expected lifetime of the shower or tub.

Also, many current supports are poorly designed with little thought given to aesthetics, and thus are eyesores. Despite the fact that the support typically is not visible after installation, the unaesthetic appearance of some current supports often leads customers to perceive the support as cheap and having subpar performance. Regardless of whether this perception is accurate, an unattractive support can lead to poor customer product reviews and lower sales.

The present invention is intended to address these problems.

BRIEF SUMMARY OF THE INVENTION

The present invention is a device for supporting a shower pan having a shower pan opening. The device comprises a tray, an intermediate layer and a top layer.

The tray is made of expanded polypropylene and comprises a substantially flat bottom panel and four side walls extending upward from the bottom panel. The bottom panel defines a tray opening. The tray defines a cavity for holding the intermediate layer and the top layer. The intermediate layer is made of oriented strand board and is disposed within the cavity adjacent and affixed to the bottom panel. The intermediate layer is substantially flat and defines an intermediate layer opening 36. The top layer is made of expanded polystyrene and is disposed within the cavity adjacent and affixed to the intermediate layer. The top layer comprises a substantially flat bottom surface, a concave top surface and a perimeter. The top layer defines a top layer opening positioned to communicate with the intermediate layer opening. The top surface of the top layer slopes inwardly from the perimeter to the top layer opening. The tray opening, the intermediate layer opening and the top layer opening are vertically aligned and together form a drain hole that is vertically aligned with a shower pan opening in the shower pan.

In another aspect of the invention a method of making a device for supporting a shower pan is provided. The method comprises the steps of: (a) Providing a tray made of expanded polypropylene, the tray comprising a substantially flat bottom panel and four side walls extending upward from the bottom panel, the bottom panel defining a tray opening, the tray defining a cavity for holding an intermediate layer and a top layer; (b) Positioning a substantially flat intermediate layer made of oriented strand board and defining an intermediate layer opening within the cavity so that the intermediate layer opening is vertically aligned with the tray opening and gluing the intermediate layer to the bottom panel; (c) Providing a top layer made of expanded polystyrene and comprising a substantially flat bottom surface, a perimeter and a concave top surface that slopes inwardly from the perimeter toward a top layer opening; and (d) gluing the bottom surface of the top layer to the intermediate layer so that the top layer opening is vertically aligned with the intermediate layer opening and the tray opening.

DETAILED DESCRIPTION OF THE INVENTION

Figure 1:
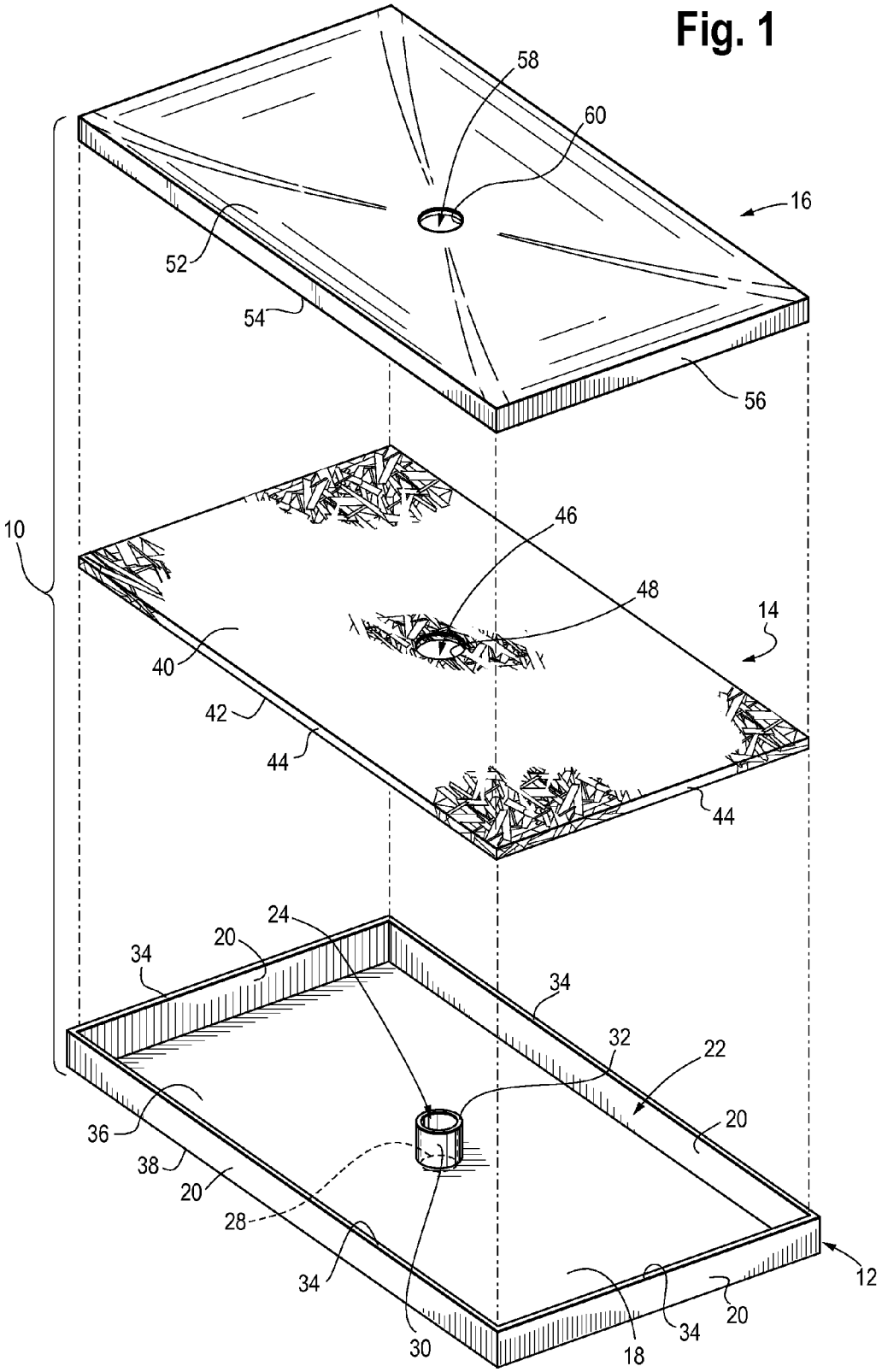
FIG. 1 is an exploded perspective view of a multi-layer shower pan support according to the invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments. Also, whenever the following disclosure refers to a support for a "shower pan" it should be understood that the device may be used to support not only shower pans, but also tubs, hot tubs and other similar fixtures.

Multi-Layer Support

Figure 2:
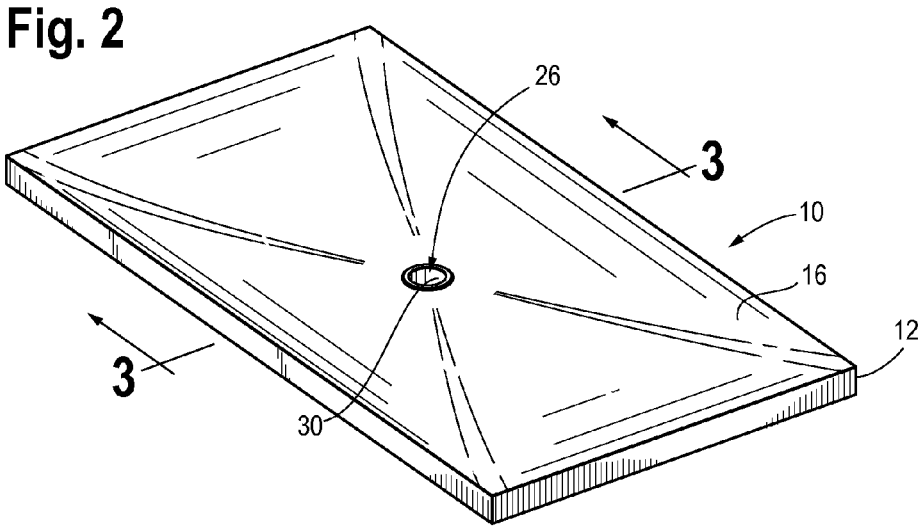
FIG. 2 is a perspective view of the multi-layer shower pan support of FIG. 1, shown assembled.
Figure 3:
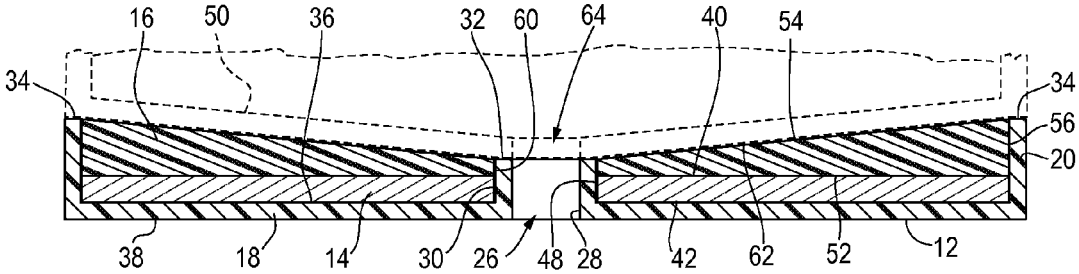
FIG. 3 is a cross-sectional view of the multi-layer shower pan support of FIG. 2 taken along lines 3-3 and shown installed under a shower pan.

Turning to the drawings, there is shown in FIGS. 1 to 3 one embodiment of the present invention, a multi-layer shower support 10. The support 10 comprises a tray 12 made of expanded polypropylene (EPP), an intermediate layer 14 made of oriented strand board (OSB), and a top layer 16 may of expanded polystyrene (EPS). The combination of materials delivers high performance, low cost and an aesthetically pleasing design.

The tray 12 cushions any vertical forces and provides vertical movement (translation) of the support 10. The tray 12 comprises a rectangular bottom panel 18 and four side walls 20 extending upward from the perimeter of the bottom panel 18 to a height substantially equal to the combined height of the intermediate layer 14 and the top layer. The tray 12 defines a cavity 22 in which the two other layers 14, 16 are placed. An opening 24 in the tray 12 is positioned to communicate with a similarly shaped and located opening 46 in the intermediate layer 14 to form part of a drain hole 26. The opening 24 has a perimeter 28, and the tray 12 may have a cylindrical wall 30 extending upward from the perimeter 28 of the opening 24 to a height substantially equal to the combined height of the intermediate layer 14 and the top layer. The cylindrical wall 30 terminates in a top edge 32. The side walls 20 also terminate in a top edge 34. The cylindrical wall top edge 32 is typically lower than the side wall top edge 34 because of the concave shape of the top layer 16. The tray 12 encloses the intermediate layer 14 and the top layer 16 when the support 10 is glued or otherwise affixed to the bottom of a shower pan 50, and thus hides the intermediate layer 14 and the top layer 16 from view to improve the aesthetic appearance of the support 10.

The tray 12 may be black in color for improved appearance. The bottom panel 18 may be substantially flat on both its top surface 36 and bottom surface 38 and is designed to lay flat against a flat shower floor. The shower floor may be made of concrete, wood or any other suitable material. The density of the tray 12 preferably is between 0.8 and 10 pounds per cubic foot (PCF). The thickness of the bottom panel 18 may be about 0.43 inches. The tray 12 serves as a cover to secure and conceal the intermediate layer 14 and the top layer 16 and also provide some slight cushioning. Because the tray 12 is molded, it has an exterior skin that increases its strength and tear resistance.

EPP was chosen for the tray material because of its combination of low cost, good performance and aesthetics. EPP is resilient and creep resistant, and displays little or no signs of permanent deformation. However, the tray 12 may be made of any suitable material, including for example expanded polyethylene (EPE) or a combination of expanded polystyrene and polyethylene (expanded PS/PE), a.k.a. expanded bead foam. Regrind or recycled material may also be added during the manufacturing process to save on virgin material and to make the tray 12 more resilient.

The intermediate layer 14 bears the brunt of any loads placed upon the support 10. The intermediate layer 14 has a height or thickness, a substantially flat top surface 40, a substantially flat bottom surface 42, a perimeter or edge 44 and an opening 46. The opening 46 has a substantially cylindrical perimeter wall 48 and is positioned to communicate with the tray opening 24 and a similarly shaped and positioned opening 58 in the top layer 16. If the tray 12 has a cylindrical wall 30 surrounding the tray opening 24, the diameter of the intermediate layer opening 46 should be about the same as the outer diameter of the cylindrical wall 30. If the tray 12 does not have a cylindrical wall 30 surrounding the tray opening 24, the diameter of the intermediate layer opening 46 should be about the same as the diameter of the tray opening 24.

The intermediate layer 14 is more rigid and less deformable than the tray 12 and the top layer 16. Because the intermediate layer 14 is a solid flat piece, it helps distribute a load imparted on the shower pan 50 throughout the support 10 and thus throughout the shower pan 50, helping to prevent cracking of the shower pan 50 due to localized load forces. Preferably the intermediate layer 14 is made from OSB having a density of between about 25 PCF and about 75 PCF and a thickness of between about 0.06 to about 1.00 inches. More preferably, the density is about 40 PCF and the thickness is less than 19/32 inches (0.59 inches) thick. For example, the intermediate layer may be about 7/16 inches (0.43 inches) thick. The use of OSB provides stiffening, distributes any load placed on the support 10 and reduces the overall cost of the support 10. The OSB minimizes deflection due to its high flexural strength, resulting in a longer lifetime of the shower pan, since the less deflection of the shower pan the less likely it is to crack. Alternatively, the intermediate layer 14 may be made of plywood or fiber board.

The top layer 16 comprises a substantially flat bottom surface 52, a concave top surface 54 (when viewed from above), a perimeter 56 and an opening 58. The opening 58 has a perimeter wall 60 and is positioned to communicate with the intermediate layer opening 46 by being vertically aligned with the intermediate layer opening 46. If the tray 12 has a cylindrical wall 30 surrounding the tray opening 24, the diameter of the top layer opening 58 should be about the same as the outer diameter of the cylindrical wall 30. If the tray 12 does not have a cylindrical wall 30 surrounding the tray opening 24, the diameter of the top layer opening 58 should be about the same as the diameter of the tray opening 24.

The top surface 52 of the top layer 16 is contoured to match the contour of the underside 62 of the shower pan 50. Typically the top surface 52 will slope inwardly from the perimeter 56 to the opening 58. As a result, the thickness of the top layer 16 may range from a maximum at the perimeter 56 to a minimum at the opening 58.

The top layer 16 preferably is made of EPS, which is both inexpensive and has the necessary compression strength. The top layer 16 preferably has a density of between about 0.8 and about 10 PCF. The top layer 16 can be readily molded into the desired shape. Because the top layer 16 is molded, it has an exterior skin that increases its strength and tear resistance over a cut foam part.

EPS was chosen for the top layer material because of its combination of low cost and good performance. EPS has good compressive strength and may be 1 molded so that the top surface 52 of the top layer 16 comes into complete contact with the underside of the shower pan 50. However, instead of EPS, the top layer 16 may be made expanded polyethylene (EPE); expanded polystyrene and polyethylene (expanded PS/PE), a.k.a. expanded bead foam; or any suitable material. Regrind or recycled material may also be added during the manufacturing process to save virgin material and to make the top layer 16 more resilient.

The tray opening 24, the intermediate layer opening 46 and the top layer opening 58 are vertically aligned and together form the drain hole 26 of the support 10. The drain hole 26 should align with the shower pan opening 64 after the support 10 is installed, and may be centrally located as shown in the figures or offset from the center.

FIG. 3 is a cross-sectional view of a shower pan support 10 shown installed under a shower pan 50. The dimensions of the support 10, including the thickness, width and depth, may be varied according to the shower pan specifications and the requirements of the shower stall manufacturer. Shower pans may be designed to sit different distances above the shower floor, and the support 10 can be designed accordingly.

For example, for a typical shower where the height of the threshold, i.e., the side of the shower floor that serves as a water barrier and that the user steps over to enter the shower, is 3.3 inches, a shower pan 50 may be designed to sit 1.75 inches above the shower floor and slope inwardly from the perimeter to a shower pan opening 64 located 1.125 inches off the shower floor. To fill up the space between the shower pan 50 and the shower floor, a support 10 may be provided with similar dimensions, i.e., a perimeter height of about 1.75 inches (where the side walls 18 are located) and sloping inward to a height of only about 1.125 inches at the drain hole 26. If the tray bottom panel 12 has a constant thickness of 0.43 inches and the intermediate layer 14 has a constant thickness of 0.44 inches, the thickness of the top layer 16 will vary from about 0.88 inches at the perimeter (1.75–0.44–0.43) to about 0.25 inches near the drain opening 26 (1.125–0.44–0.43).

The support 10 may be slightly resiliently deformable and may slightly compress and expand in the vertical direction to absorb some of the shock from the user's weight. Under the stress of normal use, the combination of layers allows the whole support to move slightly in the vertical direction while minimizing local deflection from, say a user's heal or foot. The slight vertical movement and minimum local deflection allows the shower pan to remain intact and crack free, and thus exceed the standard minimum lifecycle. The multi-layer support 10 provides better support to the shower pan 50 than plain foam supports. And, of course, the multi-layer support 10 can save the consumer money that might have to be spent on the repair of a cracked shower pan 50. The support 10 may be used in conjunction with a shower, tub or any similar product having a pan that is susceptible to cracking under pressure.

The multi-layer support 10 also looks better than conventional plain foam supports. This is because the tray 12 may be configured to completely hide the intermediate layer 14 and the top layer 16 from view when the support 10 is affixed to the underside 62 of a shower pan 50. The tray bottom wall 18 hides the underside 42 of the intermediate layer 14. The tray side walls 20 extend upward to meet the underside 62 of the shower pan 50 and thus hide the perimeter edges 44 of the intermediate layer 14 and the perimeter edges 56 of the top layer 16. The tray cylindrical wall 30 extends upward to meet the underside 62 of the shower pan 50 and thus hide the perimeter 48 of the intermediate layer opening 46 and the perimeter 60 of the top layer opening 58.

Method of Assembly

Another aspect of the invention is a method of assembling a multi-layer support 10 for supporting a shower pan 50. The method comprises the step of:

(a) providing a tray 12 made of expanded polypropylene, the tray 16 comprising a substantially flat bottom panel 18 and four side walls 20 extending upward from the bottom panel 18, the bottom panel 18 defining a tray opening 24, the tray 12 defining a cavity 22 for holding an intermediate layer 14 and a top layer 16;

(b) providing a substantially flat intermediate layer 14 made of oriented strand board and defining an intermediate layer opening 46 and positioning the intermediate layer 14 within the cavity 22 so that the intermediate layer opening 46 is vertically aligned with the tray opening 24;

(c) providing a top layer 16 made of expanded polystyrene and comprising a substantially flat bottom surface 54, a perimeter 56 and a concave top surface 52 that slopes inwardly from the perimeter 56 toward a top layer opening 58 and positioning the top layer 16 in the cavity 22 on top of the intermediate layer 14 so that the top layer opening 58 is vertically aligned with the intermediate layer opening 46.

The three layers of the support 10 may be glued or otherwise affixed together. For example, the intermediate layer 14 may be glued to the top layer 16 and to the tray 12. Alternatively, the intermediate and top layers may be affixed to the tray 12 via a friction fit or via an undercut in the tray 12.

After assembly, the tray side walls 20 extend upward from the perimeter of the bottom panel 18 to a height substantially equal to the combined height of the intermediate layer 14 and the top layer. The tray 12 may have a cylindrical wall 30 that extends upward from the perimeter 28 of the tray opening 24 to a height substantially equal to the combined height of the intermediate layer 14 and the top layer.

Installation

The assembled shower support 10 may be glued or otherwise affixed to a shower pan 50 in the factory or at the site of installation. When the support 10 is affixed to a shower pan 50, the top edge 32 of the tray cylindrical wall 30 and the top edges 34 of the tray side walls 20 may about the underside 62 of the shower pan 50, concealing the intermediate layer 14 and top layer 16. The support 10 and shower pan 50 encapsulate the intermediate layer 14 and the top layer 16 between the support 10 and the shower pan 50 with little or no empty space therebetween.

Alternative Embodiment

Figure 4:
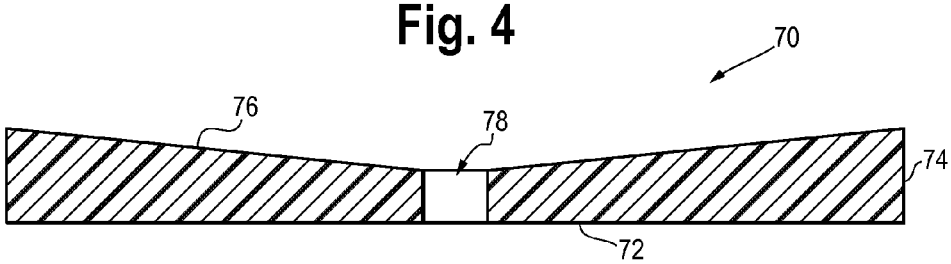
FIG. 4 is a cross-sectional view of an alternative shower pan support.

FIG. 4 is a cross-sectional view of an alternative shower pan support 70. The monolayer support 70 is made entirely of expanded polypropylene (EPP) having a density of about 1 PCF to about 12 PCF. The support 70 comprises a substantially flat rectangular bottom 72, side walls 74 extending upward from the bottom 72, and a contoured top surface 76. The support 70 defines an opening 78 extending vertically through the support 76 that aligns with the shower pan opening 64 after the support 70 is installed. The support opening 78 may be centrally located or offset from the center, depending on the location of the shower drain opening. The top surface 76 is contoured to match the contour of the underside 62 of the shower pan 50. Typically the top surface 76 will slope inwardly from the perimeter 74 of the support 70 to the opening 78. As a result, the thickness of the support 70 may range from a maximum at the perimeter 74 to a minimum at the opening 78.

Testing

A multi-layer support 10 was tested under conditions simulating almost twice the forces that would be caused by an average male getting in and out of the shower over his lifetime. The testing involved the application of repeated force in the same location (each application representing a "cycle") until failure. The multi-layer support was found to withstand about twice the number of cycles before failure, and thus was considered good for double the lifetime.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A multi-layer support for supporting a shower pan having a contoured underside and a shower pan opening, the support comprising:

a tray comprising a substantially flat bottom panel and four side walls integrally connected to and extending upward from the bottom panel, the bottom panel defining a tray opening having a perimeter, the tray defining a cavity for holding an intermediate layer and a top layer;

an intermediate layer disposed within the cavity adjacent the bottom panel, the intermediate layer being substantially planar and defining an intermediate layer opening having a diameter, the intermediate layer comprising a substantially flat bottom surface, a substantially flat top surface and a perimeter; and a top layer made of expanded polystyrene and disposed within the cavity adjacent the intermediate layer, the top layer comprising a substantially flat bottom surface, a concave top surface and a perimeter, the top layer defining a top layer opening having a diameter and positioned to communicate with the intermediate layer opening, the top surface sloping inwardly from the perimeter to the top layer opening; wherein the tray opening, intermediate layer opening and top layer opening are vertically aligned and together form a drain hole.

2. The support of claim 1 wherein:

the bottom panel has a constant thickness and a density of between about 0.8 PCF and about 10 PCF;

the intermediate layer is more rigid and less deformable than the tray and the top layer, has a constant thickness, and has a density of between about 25 and about 75 PCF; and the top layer has a variable thickness and a density of between about 0.8 and 10 PCF.

3. The support of claim 1 wherein:

the bottom panel has a constant thickness of about 0.43 inches;

the intermediate layer has a constant thickness of between about 0.06 inches and about 1.00 inches; and the top layer has a thickness that varies from about 0.88 inches at its perimeter to about 0.25 inches near the top layer opening.

4. The support of claim 1 wherein:

the intermediate layer is glued to the top layer and to the tray.

5. The support of claim 4 wherein:

the top layer is glued to the shower pan.

6. The support of claim 1 wherein:

the tray further comprises a cylindrical wall extending upward from the perimeter of the tray opening, the cylindrical wall having an outer diameter;

the diameter of the intermediate layer opening is about the same as the outer diameter of the cylindrical wall; and the diameter of the top layer opening is about the same as the outer diameter of the cylindrical wall.

7. The support of claim 1 wherein both the tray and the top layer are molded and have an exterior skin that increases their tear strength and tear resistance.

8. The support of claim 1 wherein the tray and the top layer are further made of regrind or recycled material.

9. The support of claim 1 in combination with a shower pan, the support being attached to an underside of the shower pan, wherein the intermediate layer and the top layer are completely encapsulated between the tray and the shower pan.

10. The support of claim 1 in combination with a shower pan, the support being attached to an underside of the shower pan, wherein the tray side walls abut the underside of the shower pan.

11. The support of claim 9 wherein the support and the shower pan encapsulate the intermediate layer and the top layer between the support and the shower pan with little or no empty space therebetween.

12. A method of making a support for supporting a shower pan, the method comprising the steps of:

(a) providing a tray made of expanded polypropylene, the tray comprising a substantially flat bottom panel and four side walls extending upward from the bottom panel, the bottom panel defining a tray opening, the tray defining a cavity for holding an intermediate layer and a top layer;

(b) positioning a substantially flat intermediate layer made of oriented strand board and defining an intermediate layer opening within the cavity so that the intermediate layer opening is vertically aligned with the tray opening and gluing the intermediate layer to the bottom panel;

(c) providing a top layer made of expanded polystyrene and comprising a substantially flat bottom surface, a perimeter and a concave top surface that slopes inwardly from the perimeter toward a top layer opening; and (d) gluing the bottom surface of the top layer to the intermediate layer so that the top layer opening is vertically aligned with the intermediate layer opening and the tray opening.

13. The method of claim 12 comprising the additional step of:

(e) gluing the top layer to the shower pan.

* * * * *